US009635718B2

(12) United States Patent
Kang

(10) Patent No.: US 9,635,718 B2
(45) Date of Patent: Apr. 25, 2017

(54) LIGHT EMITTING DIODE DRIVING CIRCUIT, LIGHT EMITTING DIODE CONTROLLING CIRCUIT, AND METHOD OF CONTROLLING LIGHT EMITTING DIODE

(71) Applicant: SAMSUNG ELECTRONICS CO., LTD., Suwon-si (KR)

(72) Inventor: Jeong-il Kang, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 14/577,350

(22) Filed: Dec. 19, 2014

(65) Prior Publication Data

US 2015/0296576 A1 Oct. 15, 2015

(30) Foreign Application Priority Data

Apr. 10, 2014 (KR) ..... 10-2014-0043092

(51) Int. Cl.
*H05B 33/08* (2006.01)

(52) U.S. Cl.
CPC ..... *H05B 33/0815* (2013.01); *H05B 33/089* (2013.01)

(58) Field of Classification Search
None
See application file for complete search history.

(56) References Cited

U.S. PATENT DOCUMENTS 4,749,853 A * 6/1988 Salim ..... F16P 3/14 250/221
5,153,424 A * 10/1992 Gramer ..... G01J 1/44 257/434
7,259,523 B2 8/2007 Veldman et al.
8,253,339 B1 * 8/2012 Godbole ..... H05B 33/0887 307/24
9,287,777 B2 * 3/2016 Hwang ..... H02M 3/157
9,537,403 B2 * 1/2017 Zhang ..... H02M 3/33507
2002/0140380 A1 * 10/2002 Biebl ..... H05B 33/0815 315/291
2004/0160128 A1 * 8/2004 Athari ..... H02M 1/4225 307/44
2008/0094008 A1 * 4/2008 Liu ..... H05B 33/0827 315/294
2009/0128045 A1 * 5/2009 Szczeszynski ..... H05B 33/0815 315/185 R
2011/0204802 A1 * 8/2011 Welten ..... H05B 33/083 315/193

(Continued)

FOREIGN PATENT DOCUMENTS

JP 2006-516801 A 7/2006

*Primary Examiner* — Crystal L Hammond
(74) *Attorney, Agent, or Firm* — Sughrue Mion, PLLC

(57) ABSTRACT

A light emitting diode controlling circuit includes a first integrator configured to integrate a voltage value across a resistor of a light emitting diode driving circuit, a second integrator configured to integrate a predetermined reference current value, a comparator configured to compare a first integral value output from the first integrator and a second integral value output from the second integrator, and a controller configured to control a switch according to result of comparing the first integral value and the second integral value.

7 Claims, 12 Drawing Sheets

(56) References Cited

U.S. PATENT DOCUMENTS

| | | | | |
|---|---|---|---|---|
| 2011/0260633 | A1* | 10/2011 | Takeda | H05B 33/0815 315/192 |
| 2012/0049753 | A1* | 3/2012 | Hwang | H05B 33/0818 315/224 |
| 2012/0262087 | A1* | 10/2012 | Watanabe | H05B 33/0815 315/291 |
| 2012/0286686 | A1* | 11/2012 | Watanabe | H05B 33/0815 315/224 |
| 2013/0009556 | A1* | 1/2013 | Szczeszynski | H03K 7/08 315/185 R |
| 2013/0038229 | A1* | 2/2013 | Kojima | H05B 33/0851 315/200 R |
| 2013/0082675 | A1* | 4/2013 | Capodivacca | G05F 1/468 323/283 |
| 2013/0141008 | A1* | 6/2013 | Chang | H05B 33/0815 315/291 |
| 2013/0154483 | A1* | 6/2013 | Hagan | H05B 33/0848 315/122 |
| 2014/0145646 | A1* | 5/2014 | Zhang | H05B 33/0815 315/307 |
| 2014/0184187 | A1* | 7/2014 | Hwang | H05B 33/0815 323/283 |
| 2014/0306530 | A1* | 10/2014 | Theiler | H02M 3/1584 307/31 |

* cited by examiner

LIGHT EMITTING DIODE DRIVING CIRCUIT, LIGHT EMITTING DIODE CONTROLLING CIRCUIT, AND METHOD OF CONTROLLING LIGHT EMITTING DIODE

CROSS-REFERENCE TO RELATED APPLICATIONS

This application claims priority from Korean Patent Application No. 10-2014-0043092, filed on Apr. 10, 2014, in the Korean Intellectual Property Office, the disclosure of which is incorporated herein by reference in its entirety.

BACKGROUND

1. Field

Apparatuses and methods consistent with the exemplary embodiments relate to a light emitting diode driving circuit, and more particularly, to a light emitting diode controlling circuit, a light emitting diode driving circuit, and a light emitting diode controlling method, for stable performance with respect to instant noise.

2. Description of the Related Art

Liquid crystal display (LCD) devices which are thin and lightweight and have low driving voltage and power consumption compared with other display devices have been widely used. However, since the LCD device is a non-emitting device that is not capable of emitting light by itself, the LCD device requires a separate backlight for supplying light to a liquid display panel.

As a backlight light source of the LCD device, a cold cathode fluorescent lamp (CCFL), a light emitting diode (LED), etc. have been mainly used. A CCFL is disadvantageous in that the CCFL uses mercury (Hg) which causes environmental pollution, has a low response speed and low color gamut, and is not appropriate for a light weight, short, or small LCD panel.

On the other hand, an LED is advantageous in that the LED does not use environmentally hazardous chemicals, and thus is environmentally friendly and has impulse driving. In addition, the LED is advantageous in that the LED has excellent color gamut, luminance, color temperature, etc., can randomly change by adjusting light amounts of red, green, and blue LEDs, and is appropriate for a light weight short, or small LCD panel. Accordingly, the LED has been widely used as a backlight source of an LCD panel, etc.

As a driving circuit of an LED, a buck type driving circuit is mainly used. However, the buck type driving circuit is vulnerable to noise and thus has problems in that brightness is not sufficiently realized due to noise. Accordingly, there is a need to design an LED which has stable performance with respect to noise.

SUMMARY

The exemplary embodiments overcome the above disadvantages and other disadvantages not described above. Also, the exemplary embodiments are not required to overcome the disadvantages described above, and an exemplary embodiment may not overcome any of the problems described above.

The exemplary embodiments provide a light emitting diode driving circuit having stable performance with respect to noise.

According to an aspect of the exemplary embodiments, a light emitting diode controlling circuit includes a first integrator configured to integrate a voltage value across a resistor of a light emitting diode driving circuit, a second integrator configured to integrate a predetermined reference current value, a comparator configured to compare a first integral value output from the first integrator and a second integral value output from the second integrator, and a controller configured to control a switch according to a result of the comparing.

The controller may include an off timer configured to count driving time of the light emitting diode.

The controller may include a set-reset (SR) flip flop configured to be reset according to the comparison result of the first integral value and the second integral value, and the off timer may be configured to restart the count according to the comparison result.

The SR flip flop may be reset and the off timer restarts the count when the first integral value and the second integral value are equal to each other.

The off timer may set the SR flip flop and reset the first integrator and the second integrator when the counted driving time of the light emitting diode reaches a predetermined value.

According to another aspect of the exemplary embodiments, a light emitting diode driving circuit includes a light emitting diode, a power source configured to supply power to the light emitting diode, a switch disposed between the light emitting diode and the power source and configured to selectively supply the power to the light emitting diode, an energy storage circuit configured to supply pre-stored power when the power supply of the power source is shut to a light emitting diode, and a controller configured to detect a current value flowing in the switch, to compare an integral value of the detected current value and an integral value of a predetermined current value, and to control the switch.

The energy storage circuit may include a capacitor connected in parallel to the light emitting diode, an inductor having one end commonly connected to one end of the capacitor and a cathode of the light emitting diode, and the other end connected to one end of the switch, and a diode having a cathode commonly connected to the other end of the capacitor and an anode of the light emitting diode, and an anode commonly connected to the other end of the inductor and one end of the switch.

The power source may include a resistor having one end connected to the other end of the switch and the other end connected to one end of the power source, and the controller may detect a current value flowing in the switch using a voltage of the resistor.

The controller may include an off timer configured to count the driving time of the light emitting diode.

The controller may include an SR flip flop configured to be reset according to a comparison result of the first integral value and the second integral value, and the off timer may restart the count according to the comparison result.

The SR flip flop may be reset and the off timer may restart the count when the first integral value and the second integral value are equal to each other.

The off timer may set the SR flip flop and reset the first integrator and the second integrator when the counted driving time of the light emitting diode reaches a predetermined value.

According to another aspect of the exemplary embodiments, a method of controlling a light emitting diode includes first integrating a voltage value across a resistor of a light emitting diode driving circuit, second integrating a predetermined reference current value, comparing a first integral value output in the first integrating and a second integral value output in the second integrating, and controlling a switch according to a result of the comparing.

The controlling may further include counting driving time of the light emitting diode.

The controlling may include resetting an SR flip flop according to the comparison result of the first integral value and the second integral value, and the off timer may be configured to restart the count according to the comparison result.

The SR flip flop may be reset and the off timer may restart the count when the first integral value and the second integral value are equal to each other.

The off timer may set the SR flip flop and reset the first integrator and the second integrator when the counted driving time of the light emitting diode reaches a predetermined value.

According to the various exemplary embodiments, a light emitting diode driving circuit has stable performance with respect to noise.

Additional and/or other aspects and advantages of the exemplary embodiments will be set forth in part in the description which follows and, in part, will be obvious from the description, or may be learned by practice of the exemplary embodiments.

BRIEF DESCRIPTION OF THE DRAWINGS

The above and/or other aspects will be more apparent by describing certain exemplary embodiments with reference to the accompanying drawings, in which.

DETAILED DESCRIPTION OF THE EXEMPLARY EMBODIMENTS

Certain exemplary embodiments will now be described in greater detail with reference to the accompanying drawings.

Figure 1:
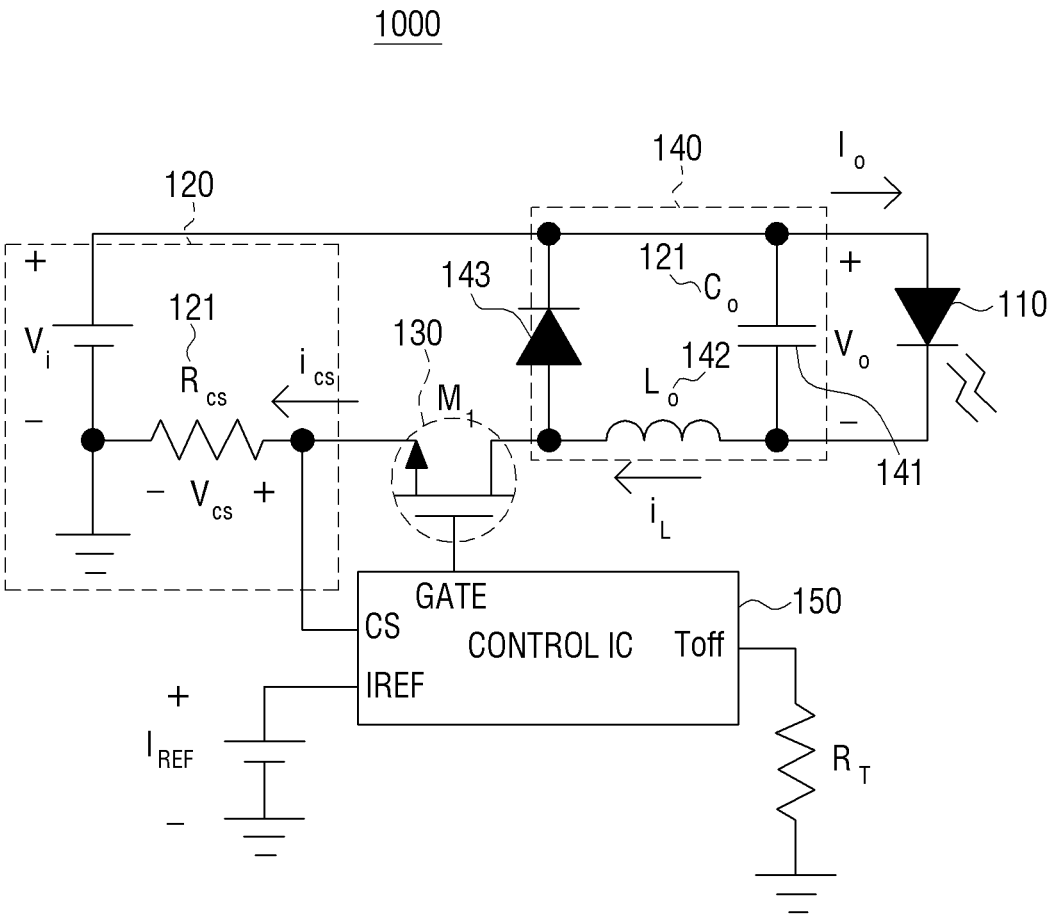
FIG. 1 is a circuit diagram of a light emitting diode driving circuit according to an exemplary embodiment.

FIG. 1 is a circuit diagram of a light emitting diode driving circuit 1000 according to an exemplary embodiment.

Referring to FIG. 1, the light emitting diode driving circuit 1000 according to an exemplary embodiment includes a light emitting diode 110, a power source 120, a switch 130, an energy storage circuit 140, and a controller 150.

The light emitting diode 110 emits light. In detail, the light emitting diode 110 emits light with a brightness corresponding to a current value supplied through the power source 120. According to the present exemplary embodiment, although only one light emitting diode is disposed in the light emitting diode driving circuit 1000. However, this is only exemplary, and an LED array formed by connecting a plurality of light emitting diodes in series to each other may be used. Additionally, an LED array formed by connecting a plurality of light emitting diodes in parallel to each other may be used.

The power source 120 is a component that supplies direct current (DC) power to the light emitting diode. The power source 120 may include a resistor 121. In this case, one end of the resistor 121 may be connected to one end of the switch 130 and the other end of the resistor 121 may be connected to one end of the power source 120.

The switch 130 is disposed between the light emitting diode 110 and the power source 120 and selectively supplies power to the light emitting diode 110. In detail, one end of the switch 130 is connected to the resistor 121 and the other end of the switch 130 is connected to the energy storage circuit 140. The switch 130 connects the power source 120 and the energy storage circuit 140 to each other upon being turned on according to a gate signal of the controller 150, and disconnects the power source 120 and the energy storage circuit 140 from each other upon being turned off.

The energy storage circuit 140 supplies pre-stored power to the light emitting diode 110 when power supply of the power source 120 is shut off. To this end, the energy storage circuit 140 includes a capacitor 141, an inductor 142, and a diode 143.

The capacitor 141 is connected in parallel to the light emitting diode 110 and is shunt such that current does not flow in the capacitor 141 when the switch 130 is turned on. On the other hand, when the switch 130 is turned off, current output from the capacitor 141 and flowing from the inductor 142 is passed.

One end of the inductor 142 is commonly connected to one end of the capacitor 141 and a cathode of the light emitting diode 110, and the other end of the inductor 142 is connected to one end of the switch 130. When the switch 130 is turned off, the inductor 142 allows current output from the capacitor 141 to flow.

A cathode of the diode 143 is commonly connected to the other end of the capacitor 141 and an anode of the light emitting diode 110, and an anode of the diode 143 is commonly connected to the other end of the inductor 142 and one end of the switch 130.

The controller 150 detects a current value flowing in the switch 130 using a voltage $V_{cs}$ of the resistor 121 and appropriately controls the switch 130.

When the switch 130 is turned on, an average value of inductor current $i_L$ has the same value as output current $I_o$ flowing in the light emitting diode 110 connected to an output end of the light emitting driving apparatus driving circuit 1000. However, both the output current $I_o$ and current $i_L$ flowing in the inductor 142 do not return to a ground GROUND and thus it is very difficult to detect the current $i_L$ flowing in the inductor 142 or the output current $I_o$ flowing in the light emitting diode 110. On the other hand, the current $i_{cs}$ flowing in the switch 130 may be easily detected through the resistor Rcs 121 connected between a source of the switch 130 and the ground GROUND.

Figure 2:
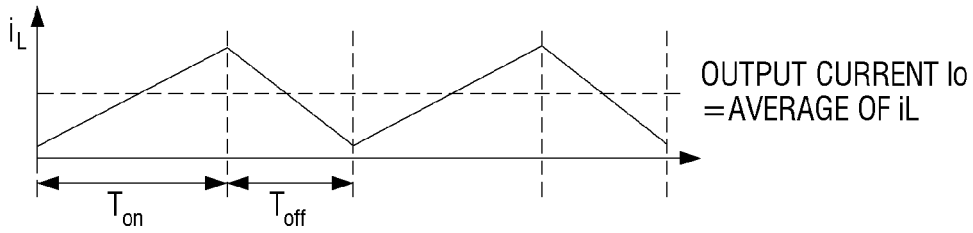
FIG. 2 is a diagram illustrating a waveform of a steady state of current flowing in an inductor.
Figure 3:
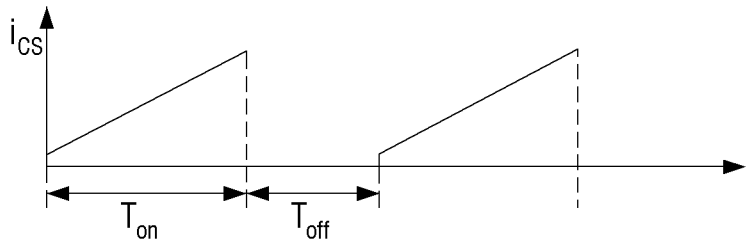
FIG. 3 is a diagram illustrating a waveform of a steady state of current flowing in a switch.

FIG. 2 is a diagram illustrating a waveform of a steady state of current $i_L$ flowing in the inductor 142. FIG. 3 is a diagram illustrating a waveform of a steady state of current $i_{cs}$ flowing in the switch 130.

Referring to FIGS. 2 and 3, with regard to the current $i_L$ flowing in the inductor 142 and the current $i_{cs}$ flowing in the switch 130, the amount of the inductor current $i_L$ increases and is the same as the current $i_{cs}$ in a period $T_{on}$ in which the switch M 130 is turned on in a steady state. In a period $T_{off}$ in which the switch M 130 is turned off, the amount of the inductor current $i_L$ decreases, and the inductor current $i_L$ does not flow in the switch M 130 and thus the current $i_{cs}$ is 0 in the period $T_{off}$.

Various methods for determining off timing of the switch 130 in the above circuit may be considered. As one method, time is counted and a switch is turned off at a desired point of time in order to control an average value of the inductor current $i_L$ to a target value using only information about the easily detected current $i_{cs}$. As another method, the current $i_{cs}$ is detected and a switch is turned off at the desired current $i_{cs}$.

Figure 4:
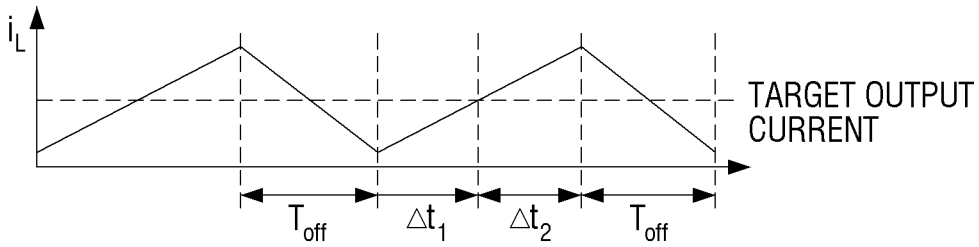
FIG. 4 is a reference diagram illustrating a method of counting time and turning off a switch.

FIG. 4 is a reference diagram illustrating a method of counting time and turning off the switch 130.

It is impossible to detect current in a period in which the switch 130 is turned off, a period $T_{off}$ corresponding to the period may be maintained at a predetermined value. Hereinafter, a period of time from a point of time when the switch 130 is turned on up to a point of time when the detected current $i_{cs}$ becomes the same as target output current is counted and is referred to as Δt1 and a period of time from a point of time when the current $i_{cs}$ becomes the same as the target output current up to a point of time when the switch 130 is turned off is counted and is referred to as Δt2. When points of time when the switch 130 is turned off are matched to equalize Δt1 and Δt2, a peak and a valley of the inductor current $i_L$ are positioned to be symmetrical to each other in a horizontal direction based on the target output current and thus an average value of the current $i_{cs}$ becomes the same as the target output current. In this circuit, since the increasing current in the period $T_{on}$ and the decreasing current in the period $T_{off}$ are the same in a steady state, the average value of current in the period $T_{off}$ is also the same as the target output current and accordingly the average value of the inductor current $i_L$ is the same as the target output current.

Figure 5:
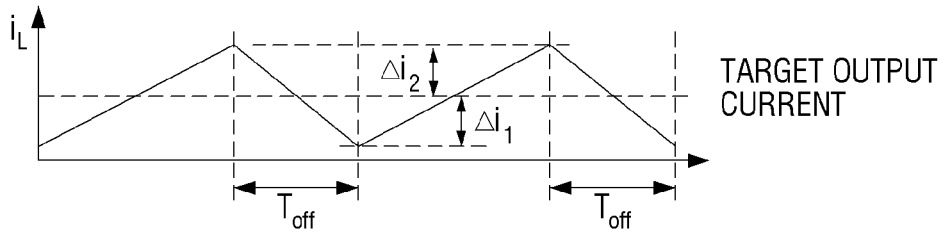
FIG. 5 is a diagram illustrating a method of detecting a current $i_{cs}$ flowing in a switch and turning off the switch.

FIG. 5 is a diagram illustrating a method of detecting the current $i_{cs}$ and turning off the switch 130.

Referring to FIG. 5, the period $T_{off}$ in which the switch 130 is turned off is maintained constant like in FIG. 4. Hereinafter, the current $i_{cs}$ detected at a point of time when the switch 130 is turned on is detected and a difference between the current $i_{cs}$ and target output current is referred to as $\Delta i_1$ and the current $i_{cs}$ detected at a point of time when the switch 130 is turned off and a difference between the current $i_{cs}$ and the target output current is referred to as $\Delta i_2$. When points of time when the switch 130 is turned off are matched to equalize $\Delta i_1$ and $\Delta i_2$, a peak and a valley of the inductor current $i_L$ are positioned to be symmetrical to each other in a horizontal direction based on the target output current and accordingly the average value of the current $i_{cs}$ is the same as the target output current as in FIG. 4. Since the increasing current in the period $T_{on}$ and the decreasing current in the period $T_{off}$ are the same in a steady state, the average value of current in the period $T_{off}$ is also the same as the target output current and accordingly the average value of the inductor current $i_L$ is the same as the target output current.

The methods shown in FIGS. 4 and 5 are basically dependent upon accurate detection of the current $i_{cs}$. With regard to the method of FIG. 4, it is important to accurately detect an intersection between the current $i_{cs}$ and a value corresponding to an average current reference. Additionally, with regard to the method of FIG. 5, it is important to accurately detect a valley and a peak of the current $i_{cs}$. However, both methods are vulnerable to noise and thus output current oscillates and accuracy thereof is degraded when noise is added to the detected current $i_{cs}$.

Figure 6:
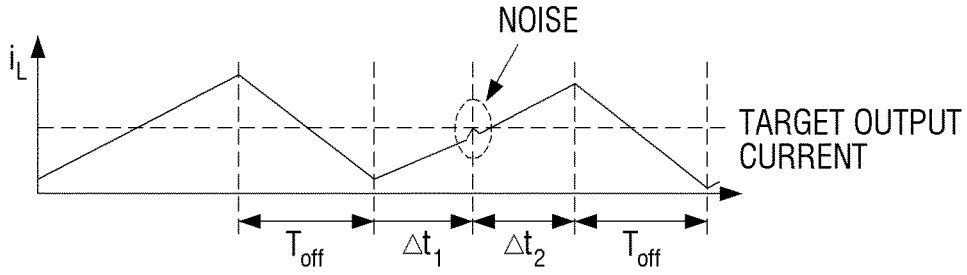
FIGS. 6 and 7 are diagrams illustrating values of inductor current when noise is generated in the respective methods.
Figure 7:
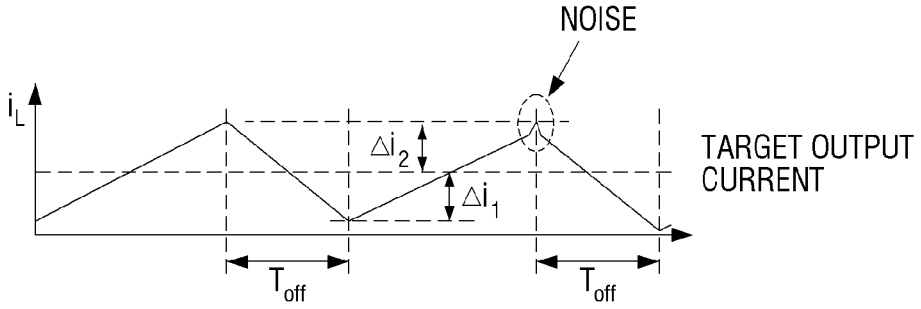

FIGS. 6 and 7 are diagrams illustrating values of inductor current when noise is generated in the respective methods.

As illustrated in FIGS. 6 and 7, when detection error occurs in the current $i_{cs}$ due to noise, the switch 130 is turned off and thus an average of inductor current is decreased compared with an average current reference.

In order to overcome this problem, the controller 150 of a light emitting diode driving circuit according to another exemplary embodiment detects a current value flowing in the switch 130, compares an integral value of the detected current with an integral value of a predetermined reference current value, and controls the switch 130, which will be described below in more detail.

Figure 8:
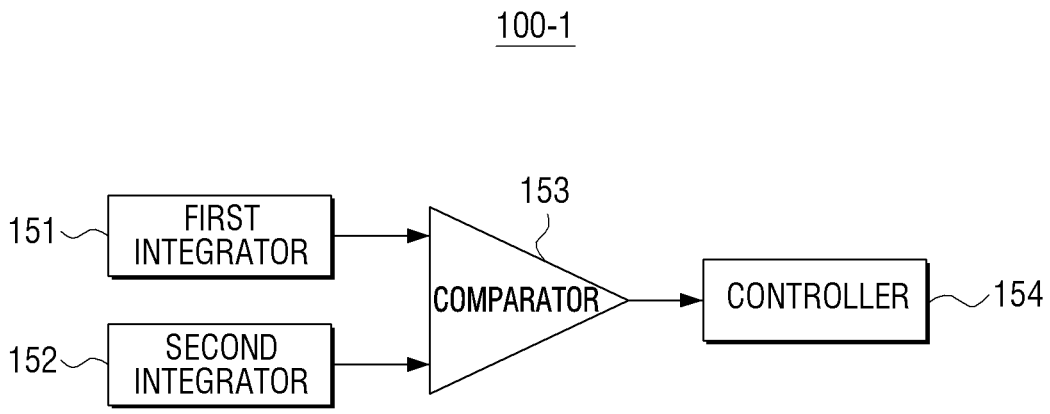
FIG. 8 is a block diagram illustrating a structure of a light emitting diode controlling circuit according to an exemplary embodiment.

FIG. 8 is a block diagram illustrating a structure of a light emitting diode controlling circuit 100-1 according to an exemplary embodiment.

Referring to FIG. 8, the light emitting diode controlling circuit 100-1 according to an exemplary embodiment includes a first integrator 151, a second integrator 152, a comparator 153, and a controller 154.

The first integrator 151 detects a current value flowing in the switch 130 of the light emitting diode driving circuit 1000 and integrates and outputs the detected current value. In other words, the first integrator 151 integrates a voltage value across two ends of the resistor 121 of a light emitting diode driving circuit.

The second integrator 152 integrates a predetermined reference current value. The reference current value is associated with a target output current.

The comparator 153 compares a first integral value output from the first integrator 151 and a second integral value output from the second integrator 152 and outputs a result of the comparison. That is, the comparator 153 determines whether the first integral value and the second integral value are equal to each other.

The controller 154 controls the switch 130 according to the comparison result. In detail, the controller 154 turns off the switch 130 when the first integral value and the second integral value are equal to each other.

Figure 9:
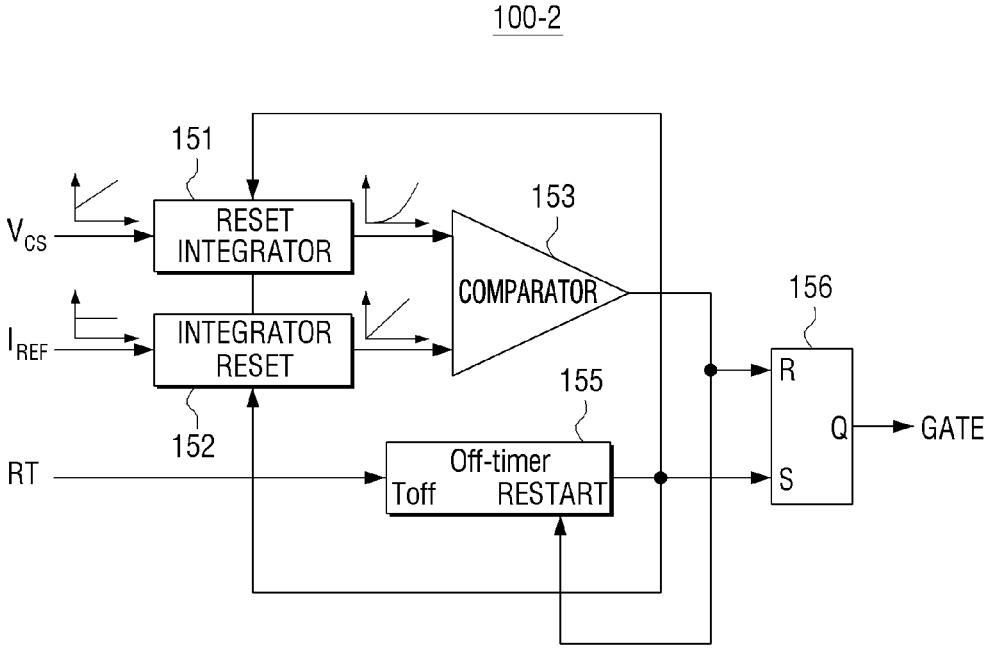
FIG. 9 is a circuit diagram of a light emitting diode controlling circuit according to another exemplary embodiment.

The light emitting diode controlling circuit 100-1 may be embodied as a circuit of FIG. 9.

FIG. 9 is a circuit diagram of a light emitting diode controlling circuit 100-2 according to another exemplary embodiment.

Similar to FIG. 8, the first integrator 151 integrates a voltage $V_{cs}$ across the resistor 121 of a light emitting diode driving circuit. The second integrator 152 integrates reference current $I_{REF}$. In addition, the comparator 153 compares the above integral values.

The controller 154 may include an SR flip-flop 156 that is reset according to the comparison result of the first integral value and the second integral value. As the comparison result, when the first integral value and the second integral value are equal to each other, the SR flip-flop 156 is reset.

In this case, the controller 154 of the light emitting diode controlling circuit 100-2 includes an off timer 155 for counting driving time of the light emitting diode 110. As the comparison result, when the first integral value and the second integral value are equal to each other, the off timer 155 restarts a count.

In addition, when the counted driving time of the light emitting diode 110 reaches a predetermined value, the off timer 155 sets the SR flip-flop 156 and resets the first integrator 151 and the second integrator 152.

Figure 10:
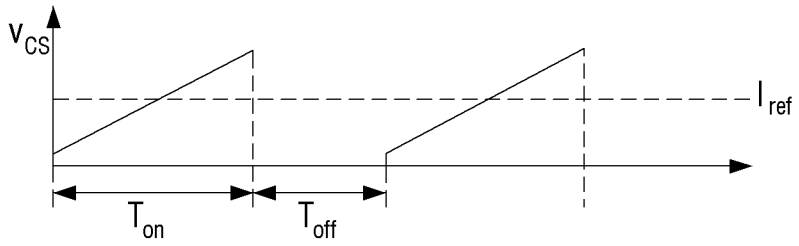
FIGS. 10 and 11 are reference diagrams illustrating an operational principle of the aforementioned light emitting diode controlling circuit.
Figure 11:
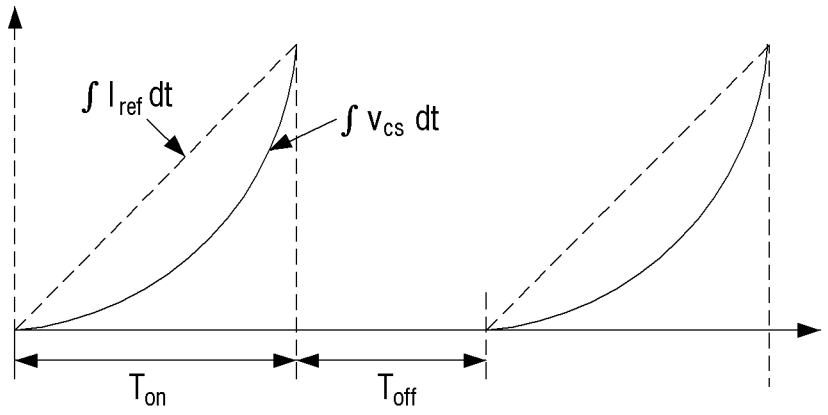

FIGS. 10 and 11 are reference diagrams for explanation of an operation principle of the aforementioned light emitting diode controlling circuit.

As illustrated in FIG. 10, assuming that an average of a voltage $V_{cs}$ obtained by sensing current $i_{cs}$ with $R_{cs}$ in a period $T_{on}$ is equal to current $I_{ref}$ supplied from an external source in order to set target output current, a definite integral value of $V_{cs}$ and a definite integral value of $I_{ref}$ in the period $T_{on}$ are equal to each other as illustrated in FIG. 11. This is because an average of a predetermined function in a predetermined period is equal to a value obtained by integrating an integral value in the period by a length of the integral period. Based on this, when a switch is turned off from a point of time when the switch is turned on and a point of time when $V_{cs}$ and $I_{ref}$ are integrated and the two integral values become equal to each other, an average of $V_{cs}$ becomes equal to $I_{ref}$ in the period of $T_{on}$. In a steady state, decreasing current in the period $T_{off}$ is equal to increasing current in the period $T_{on}$ and thus an average of $V_{cs}$ follows $I_{ref}$.

In the circuit diagram of FIG. 9, $V_{cs}$ and $I_{ref}$ are each input to an integral circuit and are passed through the comparator 153, and the SR flip-flop 156 is reset to transmit a signal for turning off the switch 130 and simultaneously the off timer 155 is restarted to start counting the period $T_{off}$ when the integral value of $V_{cs}$ and the integral value of $I_{ref}$ are equal to each other. When an off timer reaches a predetermined value according to external reference time (RT), the SR flip-flop 156 is set to turn on the switch and simultaneously each integrator is reset to integrate $V_{cs}$ and $I_{ref}$ from an initial value of 0. According to a relation $V_{cs}=i_{cs}*R_{cs}$, output current $I_o$ follows $I_{ref}/R_o$.

In addition, as necessary, gain, offset, dead time, etc. may be added to front and rear portions of each block of the circuit diagram of FIG. 9 in order to enhance detailed performance.

According to the exemplary embodiments, output current of the light emitting diode driving circuit 1000 may be controlled to a desired target current using a new method of integrating each of $V_{cs}$ and $I_{ref}$ in a period in which the switch 130 is turned on and turning off the switch in a period in which the integral values become equal to each other and is very vulnerable to instant noise.

Hereinafter, a method of controlling a light emitting diode according to various exemplary embodiments will be described.

Figure 12:
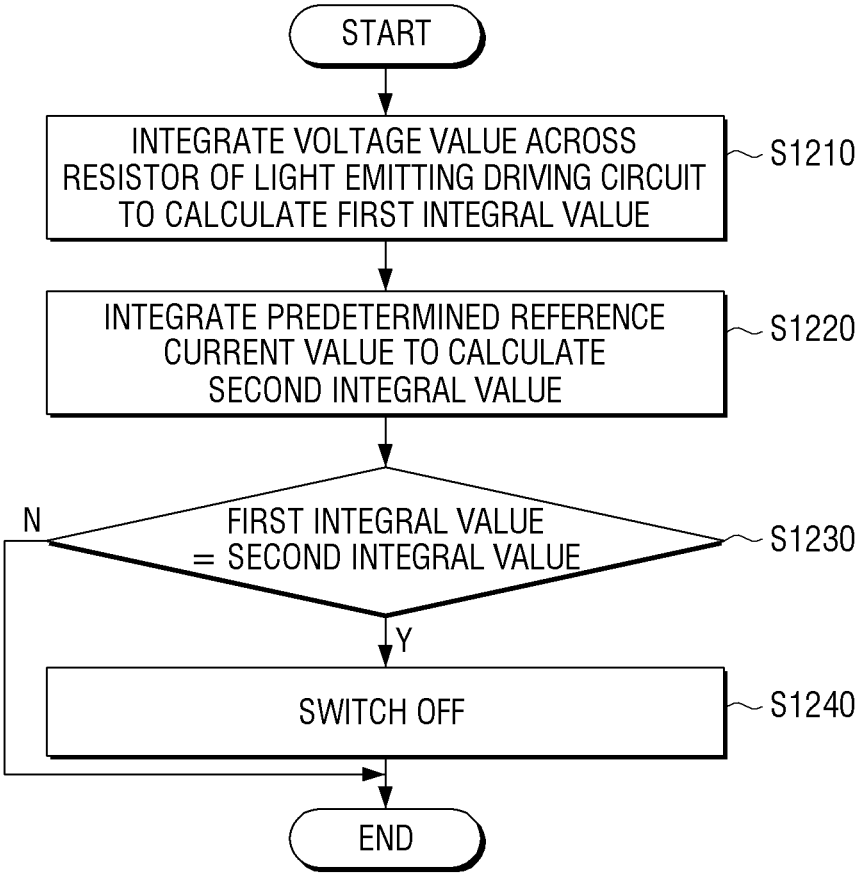
FIG. 12 is a flowchart illustrating a method of controlling a light emitting diode according to an exemplary embodiment.

FIG. 12 is a flowchart of a method of controlling a light emitting diode according to an exemplary embodiment.

Referring to FIG. 12, the light emitting diode controlling method according to an exemplary embodiment includes a first integrating operation S1210 of integrating a voltage value across a resistor of the light emitting diode driving circuit to calculate a first integral value, and a second integrating operation S1220 of integrating a predetermined reference current value to calculate a second integral value. In addition, the method includes operation S1230 of comparing the first integral value output from the first integrating operation and the second integral value output in the second integrating operation and operation S1240 of turning off a switch when result of the comparison determines that the first integral value and the second integral value are equal to each other.

In this case, the light emitting diode controlling method may further include counting driving time of the light emitting diode.

The light emitting diode controlling method may further include resetting an SR flip flop according to the comparison result of the first integral value and the second integral value. In addition, the off timer may restart a count according to the comparison result.

The method may further include resetting the SR flip flop and restarting a count by the off timer when the first integral value and the second integral value are equal to each other.

In this case, the off timer may operate so as to set the SR flip flop and to reset the first integrator and the second integrator when the counted driving time of the light emitting diode reaches a predetermined value.

The foregoing exemplary embodiments are merely exemplary and are not to be construed as limiting. The present teaching can be readily applied to other types of apparatuses. Also, the description of the exemplary embodiments is intended to be illustrative, and not to limit the scope of the claims, and many alternatives, modifications, and variations will be apparent to those skilled in the art.

What is claimed is:

1. A light emitting diode controlling circuit configured to control a buck-type driving circuit comprising a light emitting diode (LED) and a switch, comprising:

a first integrator configured to integrate a voltage value across a resistor of a LED driving circuit;

a second integrator configured to integrate a predetermined reference current value;

a comparator configured to compare a first integral value output from the first integrator and a second integral value output from the second integrator;

a set-reset (SR) flip flop configured to be reset according to a result of comparing the first integral value and the second integral value and to control the switch; and an off timer configured to count a driving time of the LED, to set the SR flip flop, to reset the first integrator and the second integrator when a counted driving time of the LED reaches a predetermined value, and to restart a count according to the result of the comparing.

2. The light emitting diode controlling circuit as claimed in claim 1, wherein the SR flip flop is reset when the first integral value and the second integral value are equal to each other.

3. A light emitting diode driving circuit comprising:

a light emitting diode (LED);

a power source configured to supply power to the LED;

a capacitor connected in parallel to the LED;

an inductor which has a first end commonly connected to a first end of the capacitor and a cathode of the LED;

a diode which has a cathode commonly connected to a second end of the capacitor and an anode of the LED, and an anode connected to a second end of the inductor;

a switch which has a first end commonly connected to the anode of the diode and a second end of the inductor and configured to selectively supply the power to the LED; and a controller configured to detect a current value flowing in the switch, to compare an integral value of the detected current value and an integral value of a predetermined current value, and to control the switch, wherein the controller comprises:

a set-reset (SR) flip flop configured to be reset according to the result of comparing the first integral value and the second integral value; and an off timer configured to count a driving time of the LED, to set the SR flip flop, to reset the first integrator and the second integrator when the counted driving time of the light emitting diode reaches a predetermined value, and to restart a count according to the result of the comparing.

4. The light emitting diode driving circuit as claimed in claim 3, wherein:

the power source comprises a resistor which has a first end connected to a second end of the switch and a second end connected to a first end of the power source; and the controller detects a current value flowing in the switch using a voltage of the resistor.

5. The light emitting diode driving circuit as claimed in claim 3, wherein the SR flip flop is reset when the first integral value and the second integral value are equal to each other.

6. A method of controlling a light emitting diode (LED), the method comprising:

a first integrating step of integrating a voltage value across a resistor of a LED driving circuit;

a second integrating step of integrating a predetermined reference current value;

comparing a first integral value output in the first integrating step and a second integral value output in the second integrating step; and controlling a switch according to a result of the comparing, wherein the controlling comprises counting a driving time of the LED;

resetting a set-reset (SR) flip flop according to the result of comparing the first integral value and the second integral value; and an off timer is configured to restart a count according to the result of the comparing, and to set the SR flip flop and to reset first integrator, which performs the first integrating step, and a second integrator which performs the second integrating step when the counted driving time of the LED reaches a predetermined value.

7. The method as claimed in claim 6, wherein the SR flip flop is reset when the first integral value and the second integral value are equal to each other.

* * * * *